US006957508B2

(12) United States Patent
Sato

(10) Patent No.: US 6,957,508 B2
(45) Date of Patent: Oct. 25, 2005

(54) SAFETY MECHANISM FOR BOLT-ACTION FIREARM

(75) Inventor: Teruhiko Sato, Aichi-Ken (JP)

(73) Assignee: Howa Machinery, Ltd., Aichi-ken (JP)

( * ) Notice: Subject to any disclaimer, the term of this patent is extended or adjusted under 35 U.S.C. 154(b) by 38 days.

(21) Appl. No.: 10/797,314

(22) Filed: Mar. 10, 2004

(65) Prior Publication Data

US 2004/0216347 A1 Nov. 4, 2004

(30) Foreign Application Priority Data

Apr. 2, 2003 (JP) ..... 2003-098695

(51) Int. Cl.[7] ..... F41A 17/00
(52) U.S. Cl. ..... 42/70.06; 42/70.01; 42/14
(58) Field of Search ..... 42/70.06, 70.01, 42/14, 16; 89/27.12

(56) References Cited

U.S. PATENT DOCUMENTS 2,379,946 A * 7/1945 Baker ..... 42/70.06
2,490,474 A * 12/1949 Roemer ..... 42/70.05
2,514,981 A 7/1950 Walker et al.
2,869,269 A * 1/1959 Couture ..... 42/70.06
3,024,559 A * 3/1962 Weatherby ..... 42/70.06
3,130,513 A * 4/1964 Knode, Jr. ..... 42/70.06
4,870,770 A 10/1989 Forbes et al.
5,551,180 A * 9/1996 Findlay et al. ..... 42/70.01
5,752,338 A * 5/1998 Lameiras Guede ..... 42/70.06
6,018,900 A * 2/2000 Guede ..... 42/70.06
6,073,380 A 6/2000 Hauser et al.

FOREIGN PATENT DOCUMENTS

JP 04 78919 12/1992

* cited by examiner

*Primary Examiner*—M. Clement
(74) *Attorney, Agent, or Firm*—Ladas and Parry LLP

(57) ABSTRACT

A safety lever (safety control member) is provided in its inner surface with first, second and third positioning holes. The tapered outer end part of a safety lock (trigger blocking member) is engaged in the first positioning hole of the safety lever to retain the safety lever at a perfect lock position. In this state, the forward turning of the upper arm of the trigger is blocked by the safety lock. Thus, the trigger cannot turn even if the same is pulled. Since the safety lock is fitted in a sliding hole formed in a casing so as to be slidable in directions perpendicular to a plane in which the trigger turns, and force applied to the trigger is born by the casing, the safety lock does not deform and is able to block the movement of the trigger with reliability even if the trigger is pulled strongly. In this state where the safety lever is at the perfect lock position, the bolt blocking part of the safety lever is engaged in a groove formed in a bolt. In this state, the bolt is locked perfectly and cannot be turned to open the chamber. When the safety lever is turned to a safety position, the bolt can be operated, while the trigger is still restrained from turning by the trigger blocking part of the safety lock.

7 Claims, 8 Drawing Sheets

SAFETY MECHANISM FOR BOLT-ACTION FIREARM

BACKGROUND OF THE INVENTION

1. Field of the Invention

The present invention relates to a safety mechanism capable of selectively blocking the movement of a bolt and a trigger included in a bolt-action firearm. More particularly, the present invention relates to a safety mechanism capable of selectively maintaining a firearm in the following three positions: a perfect lock position where neither the bolt nor the trigger of the firearm is movable (operatable); a safety position where the bolt is operatable and the trigger is unoperatable; and a firing position where both the bolt and the trigger are operatable.

2. Description of Related Art

A safety mechanism disclosed in JP-B 4-78919 (Patent document 1) includes: a selector lever, i.e., a safety lever, capable of being turned about a longitudinal axis selectively to one of three positions, i.e., a perfect lock position, a safety position and a firing position; and a trigger locking lever having a control surface formed in one end thereof and capable of engaging with a cam surface formed in the selector lever. The trigger locking lever is provided with a trigger blocking part formed in a front end part thereof, and is supported for turning in horizontal directions such that the trigger blocking part can be projected to a position in front of the upper arm of a trigger and can be retracted from the position in front of the upper arm of the trigger. When the selector lever is turned to the perfect lock position, the front end part of the trigger locking lever engages with the front side of the upper arm of the trigger to block the movement of the trigger. In this state, the selector lever is operated by the selector spur so as to engage a locking plunger with the bolt to lock the bolt. When the selector lever is turned to the safety position, the selector spur is separated from the locking plunger to permit the operation of the bolt, while the trigger locking lever holds the trigger in a locked position. When the selector lever is turned to the firing position, both the trigger and the bolts are operatable.

A safety mechanism disclosed in U.S. Pat. No. 6,073,380 (Patent document 2) includes a safety lever. When the safety lever is turned to a releasing position (firing position) or a first locking position (safety position), the safety lever is retracted away from a bolt so that the bolt is operatable. When the safety lever is turned to a second locking position (perfect lock position), the safety lever blocks the movement of the bolt. When the safety lever is moved from the releasing position to either the first or the second locking position, a groove formed in the safety lever pushes a projection formed in a plate spring, which has a fixed end connected to a housing and a movable end, to shift the movable end of the plate spring from a releasing position to a blocking position in the moving path of the upper arm of a trigger to block the movement of the trigger. When the safety lever is set in the releasing position, the movable end of the plate spring is located outside the moving path of the upper arm of the trigger to permit the movement of the trigger.

Another safety mechanism capable of selecting those three positions is disclosed in U.S. Pat. No. 4,870,770 (Patent document 3). In addition, a safety mechanism disclosed in U.S. Pat. No. 2,514,981 (Patent document 4) is capable of selecting either of a perfect lock position and a firing position. This safety mechanism determines the position of a bolt locking arm relative to a bolt engaging groove by means of an urged ball and two positioning holes.

However, in the safety mechanism disclosed in Patent document 1, the selector lever is positioned selectively in one of the three positions by a positioning mechanism including a spring-urged locking member that engages selectively in one of three recesses. The safety mechanism includes, in addition to the positioning mechanism, a trigger locking mechanism including a trigger locking lever having a trigger locking part and supported for turning in horizontal directions and hence the safety mechanism has complicated construction.

In the safety mechanism disclosed in Patent document 2, the groove formed in the safety lever pushes the triangular projection of the plate spring so that the movable part of the plate spring is located in the moving path of the upper arm of the trigger to block the movement of the trigger. Therefore, if the trigger is pulled forcibly, the movable part of the plate spring is forced out of the moving path of the upper arm of the trigger because the plate spring warps resiliently. Consequently, the movement of the trigger cannot be blocked and there is a possibility that the firing mechanism operates accidentally.

The safety mechanisms disclosed in Patent documents 3 and 4 are complicated in construction.

SUMMARY OF THE INVENTION

The present invention has been made in view of those problems in the related art and it is therefore an object of the present invention to provide a safety mechanism for use in firearms, which is simple in construction and capable of blocking the movement of the trigger with reliability when the safety lever is in the safety position or the perfect lock position.

The present invention provides a safety mechanism for use in a bolt-action firearm that includes a receiver, a bolt axially slidably received in the receiver, a casing fastened to a lower part of the receiver, a firing mechanism, and a trigger having an upper arm and pivotally supported on the casing so as to be interlocked with the firing mechanism. The safety mechanism comprises: a safety control member supported for turning on an outer surface of one of opposite side walls of the casing and capable of being selectively located in one of first, second and third positions so as to control movement of the trigger and the bolt, the safety control member having a bolt blocking part capable of engaging with the bolt; a trigger blocking member slidably fitted in a sliding hole of the casing, the sliding hole being provided in the outer surface of the one of the opposite side walls of the casing, on which the safety control member is supported, the sliding hole opening into a space between the opposite side walls of the casing, in which the upper arm of the trigger moves, the trigger blocking member having a trigger blocking part capable of moving so as to be advanced into and retracted from a moving path of the upper arm of the trigger; and a spring urging the trigger blocking member fitted in the sliding hole of the casing toward the safety control member; wherein the safety control member is provided with first, second and third positioning holes arranged on a circle having its center on an axis on which the safety control member turns; the trigger blocking member engages in the first, the second and the third positioning holes of the safety control member to locate the safety control member in the first, the second and the third positions, respectively; the bolt blocking part of the safety control member is engaged with the bolt to block the movement of the bolt when the safety control member is located in the first position, whereas the bolt blocking part of the safety control member is disengaged from the bolt to permit the bolt to be operated when the safety control member is located in the second or the third position; the trigger blocking part of the trigger blocking member is advanced into the moving path of the upper arm of the trigger to block the movement of the trigger when the safety control member is located in the first or the second position, whereas the trigger blocking part of the trigger blocking member is retracted from the moving path of the upper arm of the trigger to permit the trigger to move when the safety control member is positioned in the third position.

According to the safety mechanism of the present invention, the position of the safety control member is determined by the trigger blocking member; in addition, the position of the trigger blocking member in the sliding hole of the casing is determined by the positioning holes of the safety control member, and the trigger blocking part of the trigger blocking member is moved into and out of the moving path of the upper arm of the trigger. Thus, the safety mechanism is simple in construction as compared with a safety mechanism separately provided with a safety lever positioning mechanism and a trigger blocking mechanism. Since the trigger blocking member is slidably fitted in the sliding hole of the casing, the trigger blocking member does not warp like the plate spring to permit the trigger to move, even if the trigger is pulled strongly.

In the safety mechanism of the present invention, it is preferable that the first and the second positioning holes of the safety control member are formed in a shape such that the trigger blocking part of the trigger blocking member lies inside the moving path of the upper arm of the trigger when an outer end part of the trigger blocking member is engaged in the first or the second positioning hole; and the third positioning hole is formed in a shape such that the trigger blocking part of the trigger blocking member lies outside the moving path of the upper arm of the trigger when the outer end part of the trigger blocking member is engaged in the third positioning hole. In this arrangement of the safety mechanism, it is preferable that the outer end part of the trigger blocking member is tapered; the third positioning hole is a tapered hole having a large diameter and capable of entirely receiving the tapered outer end part of the trigger blocking member to locate the trigger blocking part of the trigger blocking member at a releasing position outside the space between the opposite side walls of the casing; the first and the second positioning holes are tapered holes having small diameters and capable of partly receiving the tapered outer end part of the trigger blocking member to locate the trigger blocking part of the trigger locking member at a blocking position inside the space between the opposite side walls of the casing.

In the safety mechanism of the present invention, it is preferable that the sliding hole of the casing is provided in a part of the casing which part corresponds to a position in front of the upper arm of the trigger, and the sliding hole of the casing has an axis parallel to an axis about which the trigger turns.

In the safety mechanism of the present invention, the safety control member may be supported for turning on the same axis as the axis around which the trigger turns.

In the safety mechanism of the present invention, it is preferable that the safety control member has a sectorial central body, an operating arm upwardly extending from an upper back part of the central body, and a bolt locking arm upwardly extending from an upper front part of the central body, the bolt locking arm serves as the bolt blocking part; the central body of the safety control member is provided with the three positioning holes formed in an inner surface thereof facing the outer surface of the one of the opposite side walls of the casing; and the bolt locking arm of the safety control member is engaged in a longitudinal groove formed in the bolt to block the movement of the bolt. In addition, this arrangement of the safety mechanism may further comprise a safety control member retaining member supported on the casing in sliding contact with an upper edge of the central body of the safety control member to retain the safety control member in place on the casing. Since the safety control member retaining member retains the safety control member urged resiliently outward by the spring close to the side wall of the housing, the safety lever may not play and may be stably positioned at any one of the three positions.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
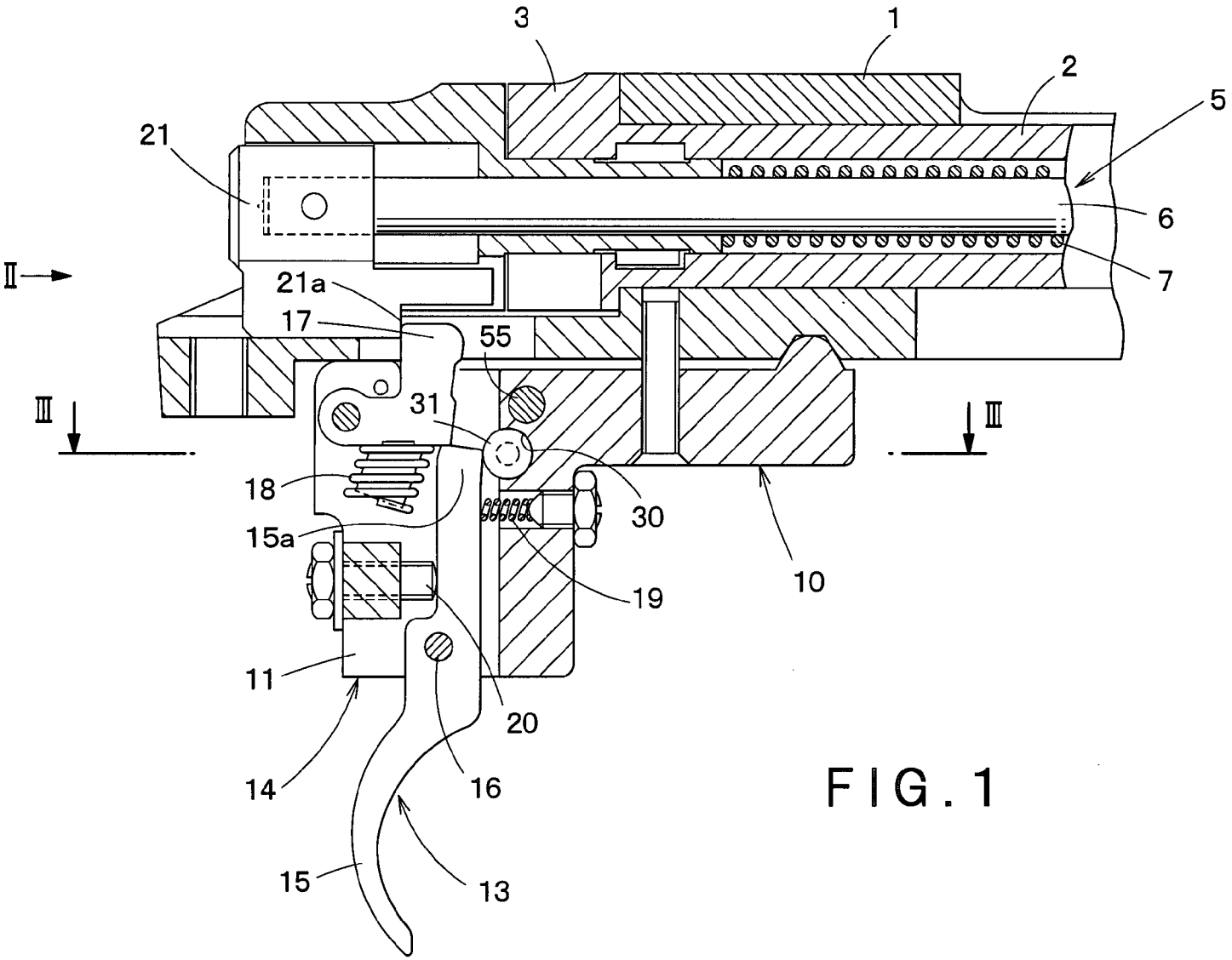
FIG. 1 is a longitudinal sectional view of a part of a bolt-action firearm around a trigger and a firing mechanism, the bolt-action firearm including a safety mechanism of an embodiment of the present invention.
Figure 2:
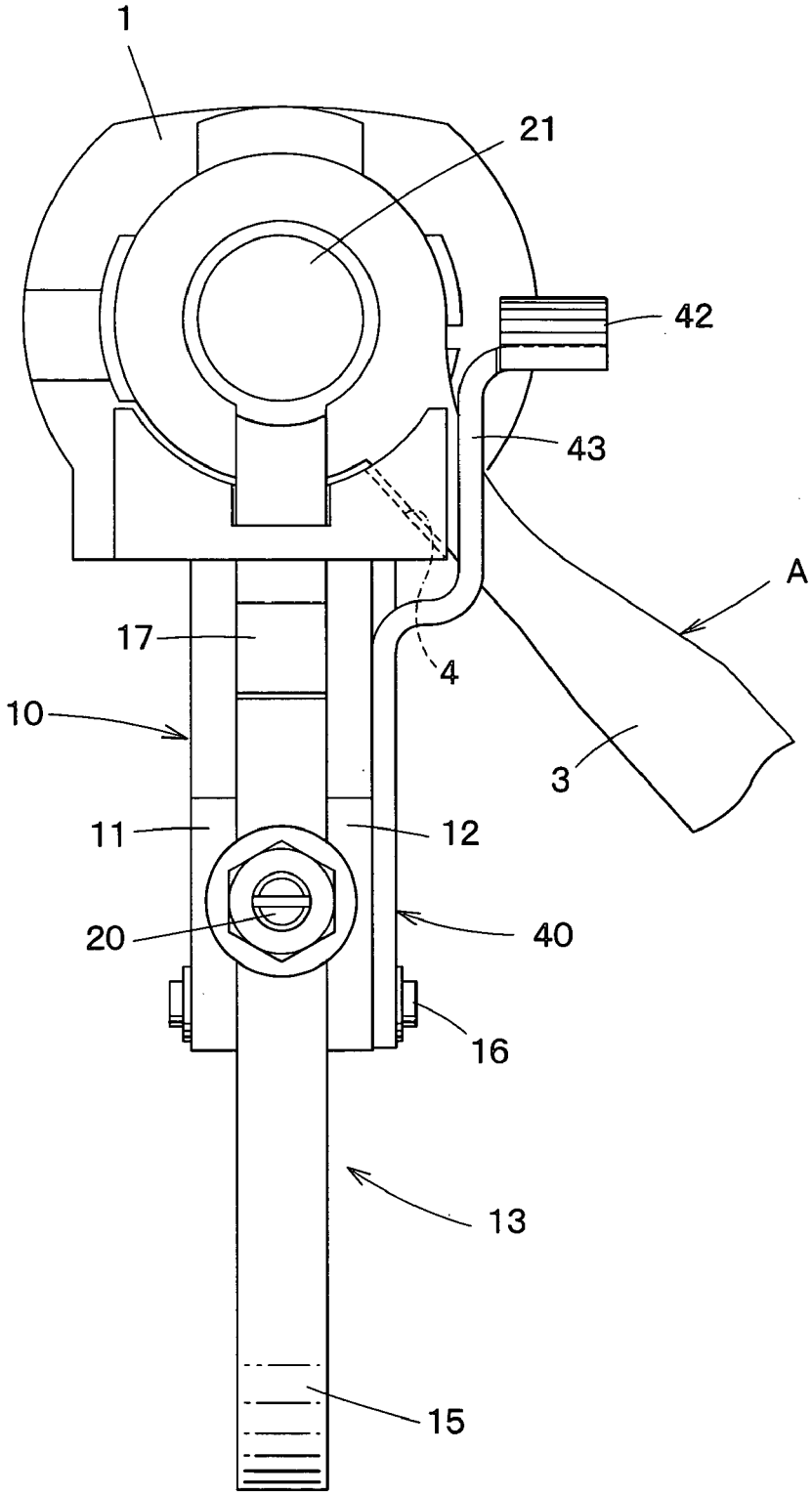
FIG. 2 is a view taken in the direction of the arrow II in FIG. 1.
Figure 3A:
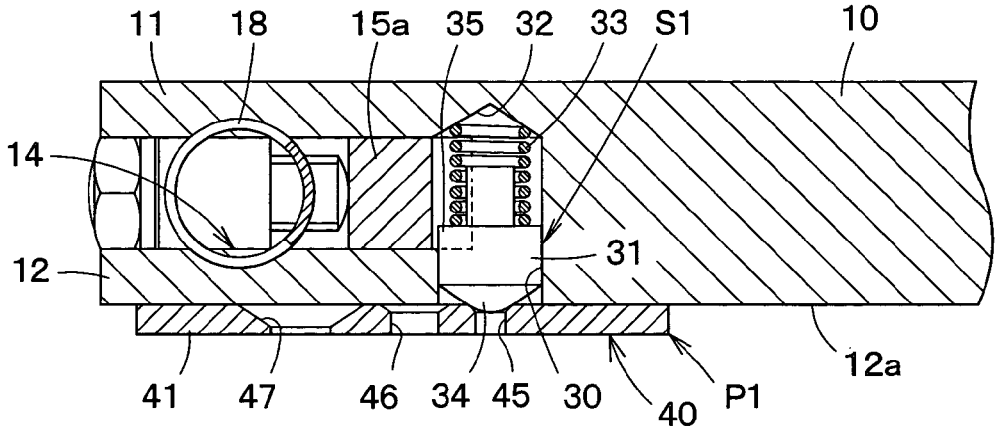
FIGS. 3A, 3B and 3C are sectional views taken on the line III—III in FIG. 1, in which the safety lever is in a perfect lock position, a safety position and a firing position, respectively.
Figure 3B:
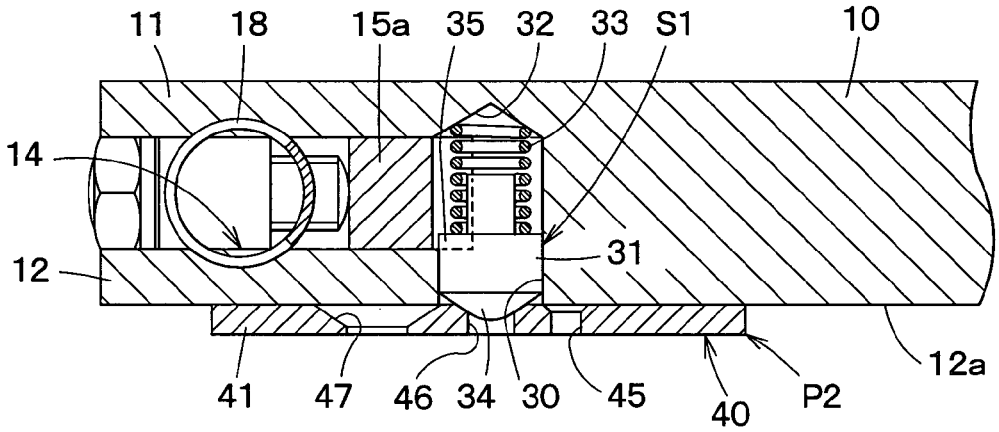
Figure 3C:
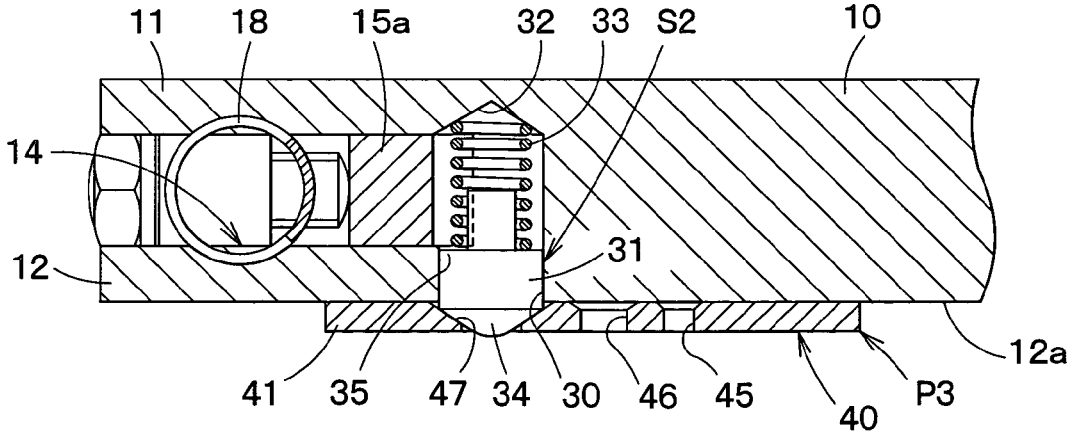

Referring to FIG. 1, a bolt 2 is fitted axially slidably in a receiver 1 attached to a rear part of a gunbarrel, not shown, so as to be turnable about its own axis. A bolt handle 3 for turning and axially moving the bolt 2 is formed integrally with a rear part of the bolt 2. The bolt handle 3 rests on an oblique handle stopping surface 4 formed in the receiver 1 when the bolt handle 3 is set at a closing angular position A as shown in FIG. 2. A firing pin 6 included in a firing mechanism 5 is axially movably inserted in the bolt 2 and is urged forward by a firing pin spring 7. A casing (trigger frame) 10 is fastened to a lower part of the receiver 1. The casing 10 has a left side wall 11 and a right side wall 12 defining a groove 14 for receiving a trigger mechanism 13. The trigger mechanism 13 includes a trigger 15 disposed in the groove 14 between the opposite side walls 11 and 12. The trigger 15 is supported for forward and backward turning on the opposite side walls 11 and 12 by a support pin 16 passing through a middle part of the trigger 15. The support pin 16 has a part projecting outside from the right side wall 12 and supporting a safety lever (safety control member) 40. An upper arm 15*a* of the trigger 15 has a thickness substantially equal to the distance between the respective inner surfaces of the left side wall 11 and the right side wall 12 of the casing 10. The upper arm 15*a* of the trigger 15 lies between the left side wall 11 and the right side wall 12 of the casing 10 as shown in FIGS. 3A to 3C. A sear 17 is pivotally supported on the casing 10 and is urged upward by a sear spring 18. The tip of the upper arm 15*a* of the trigger 15 can be engaged with and disengaged with the lower surface of a front part of the sear 17. When the bolt 2 is fitted in the receiver land the bolt handle 3 is turned to the closing angular position A, the parts are set in a firing state as shown in FIG. 1 with the trigger 15 being pressed against a stopper 20 with a trigger spring 19. When the trigger 15 in the firing state is pulled, the upper arm 15*a* of the trigger 15 turns forward, and the trigger 15 is disengaged from the sear 17. Then, the sear 17 is turned clockwise by the resilience of the trigger spring 19, and an upper part of the sear 17 is disengaged from a step 21*a* formed in a cocking piece 21 to permit the firing pin 6 to advance together with the cocking piece 21. Consequently, the firing pin 6 strikes and detonates a sensitive explosive of the cartridge loaded in the chamber to shoot a bullet. The aforementioned mechanism is well-known.

A safety mechanism in a preferred embodiment of the present invention will be now described. Referring to FIGS. 3A to 3C, a sliding hole 30 having a circular cross section is formed through a part of the right side wall 12 of the casing 10. The sliding hole 30 is placed at a position in front of the upper arm 15*a* of the trigger 15. The axis of the sliding hole 30 is parallel to that of the support pin 16. A part of the sliding hole 30 is cleared away by the groove 14 that is a space between the opposite side walls 11 and 12 of the casing 10. The sliding hole 30 opens into the groove 14 and has a bottom end formed in the left side wall 11. A safety lock 31 having a circular cross section is axially slidably fitted in the sliding hole 30. A coil spring 33 is extended between the bottomed end, formed in the left side wall 11, of the sliding hole 30 and the safety lock 31 to urge the safety lock 31 outward. The safety lock 31 has a tapered outer end 34. The diameter of the safety lock 31 is greater than the outside diameter of the coil spring 33. The inner end of the safety lock 31 serves as a trigger blocking part 35. The trigger blocking part 35 can be projected into and retracted from the groove 14.

Figure 4:
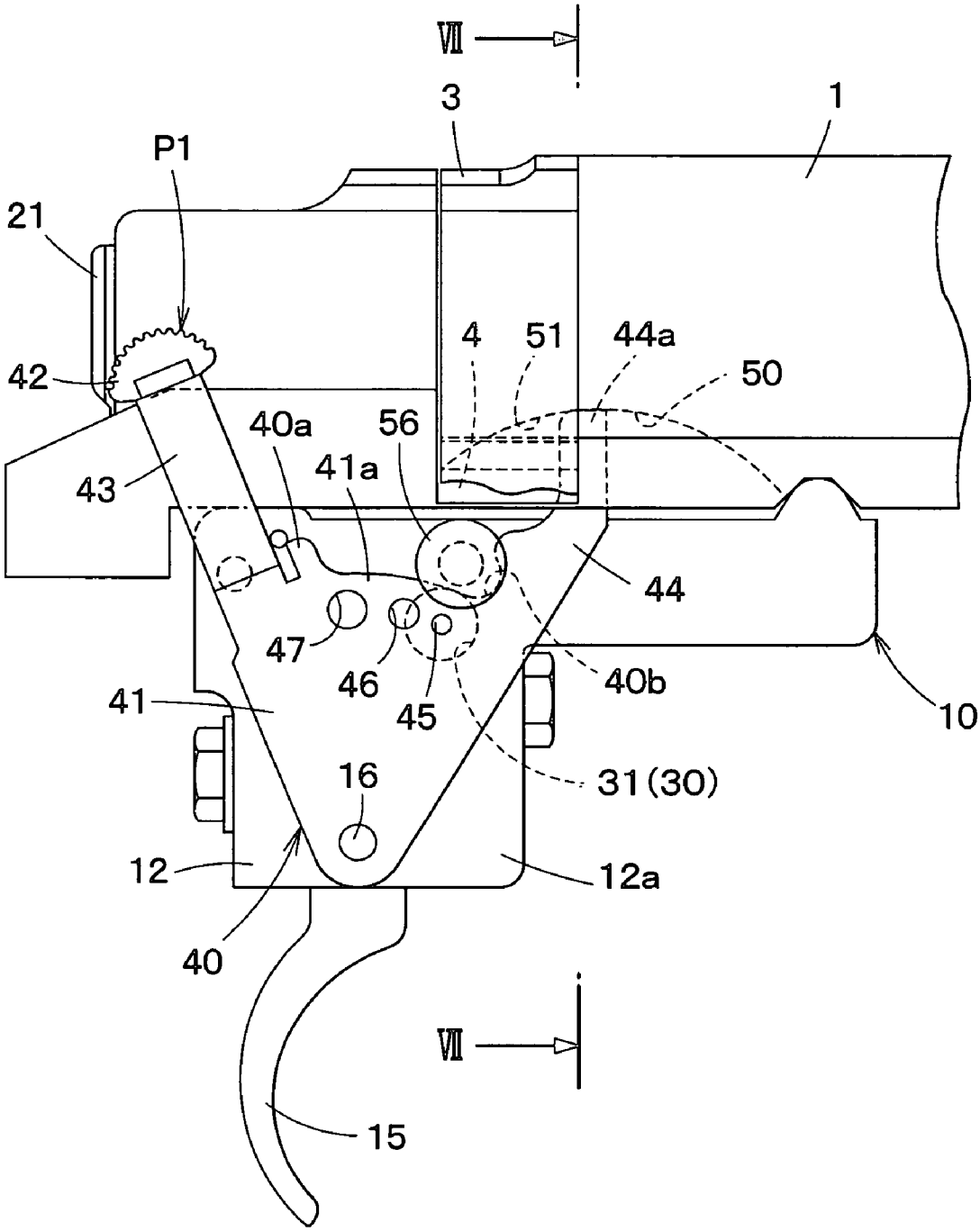
FIG. 4 is a right-hand side elevation of the part shown in FIG. 2, with the safety lever being in the perfect lock position.
Figure 5:
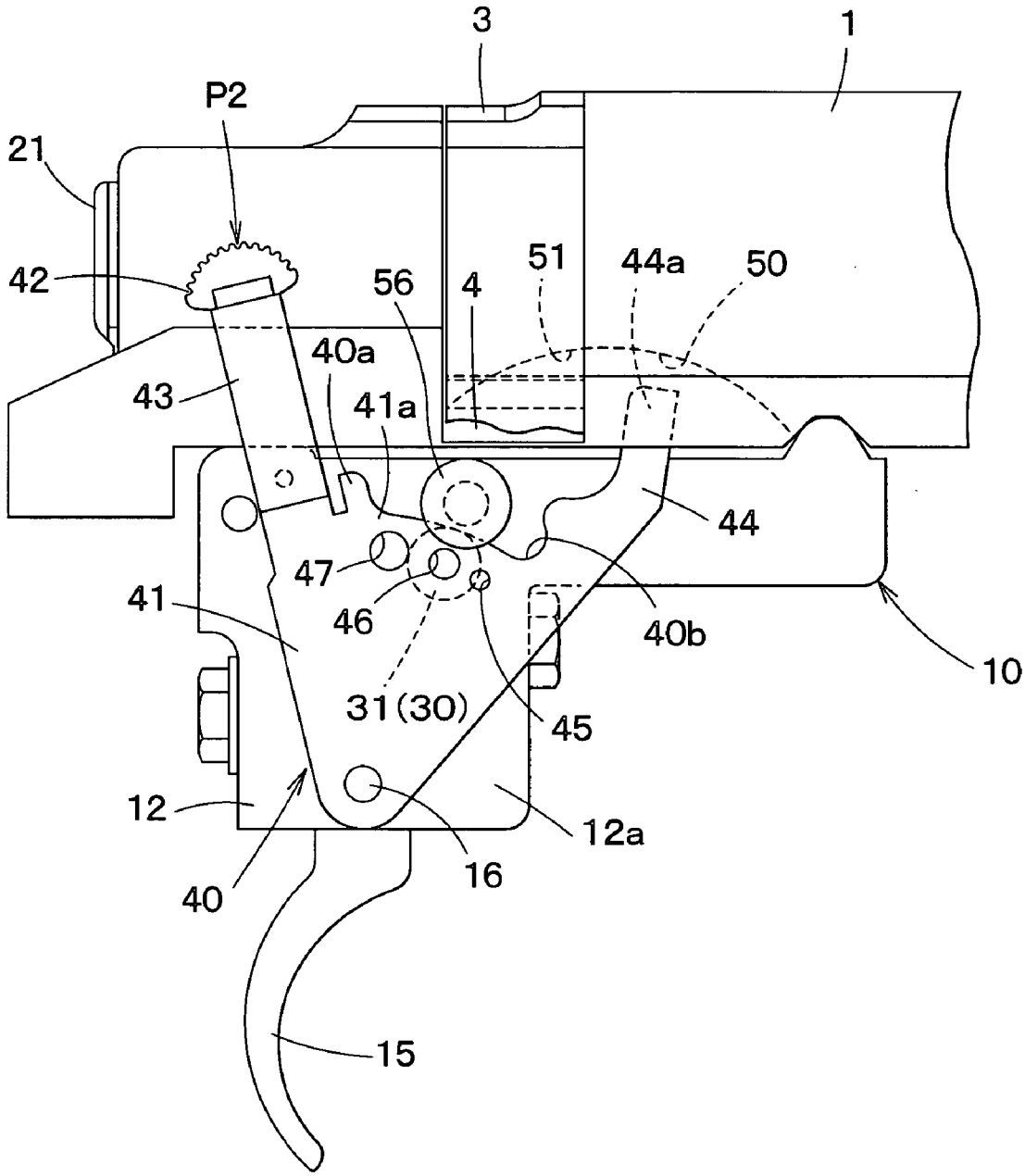
FIG. 5 is a right-hand side elevation of the part shown in FIG. 2, with the safety lever being in the safety position.
Figure 6:
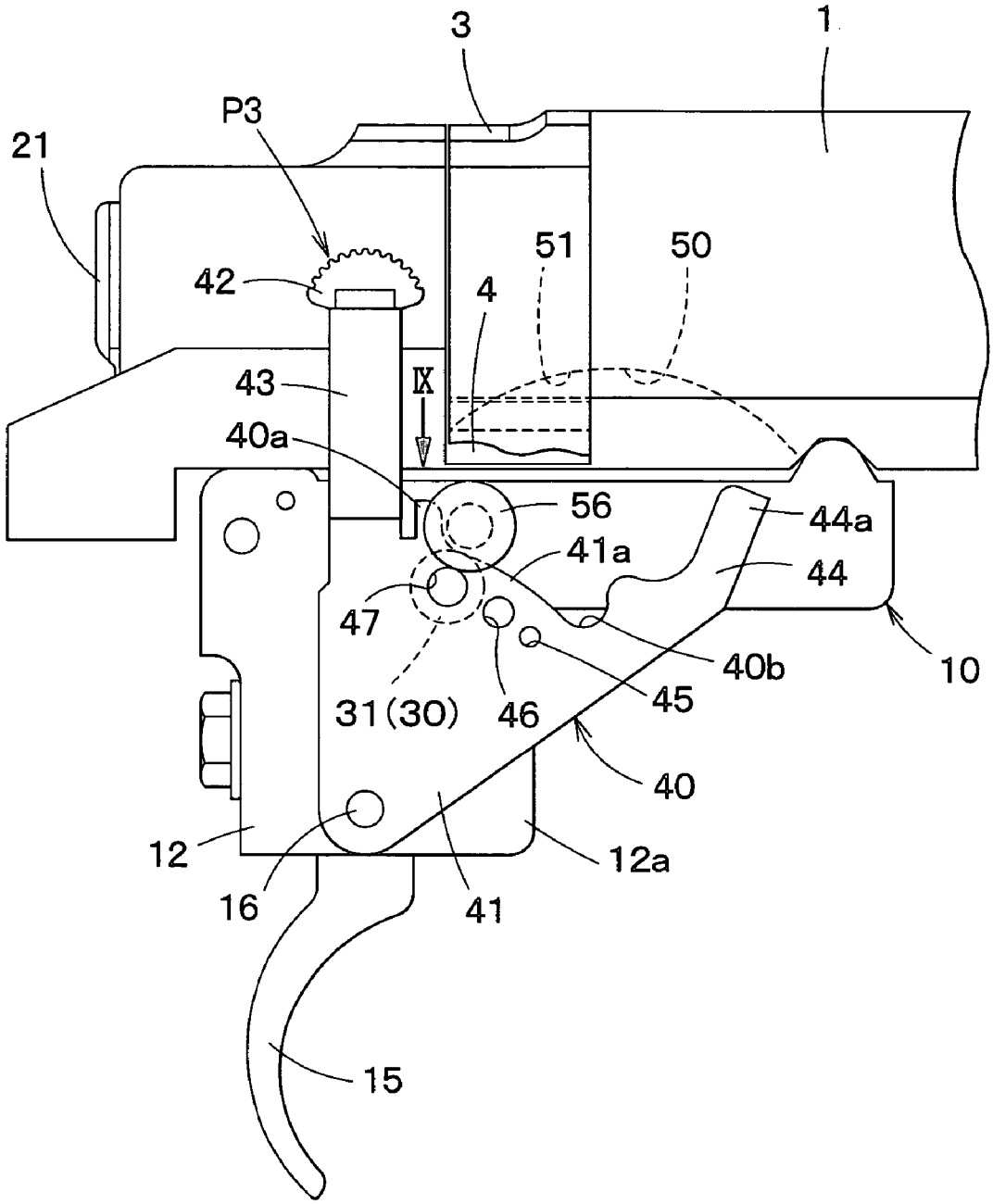
FIG. 6 is a right-hand side elevation of the part shown in FIG. 2, with the safety lever being in the firing position.
Figure 7:
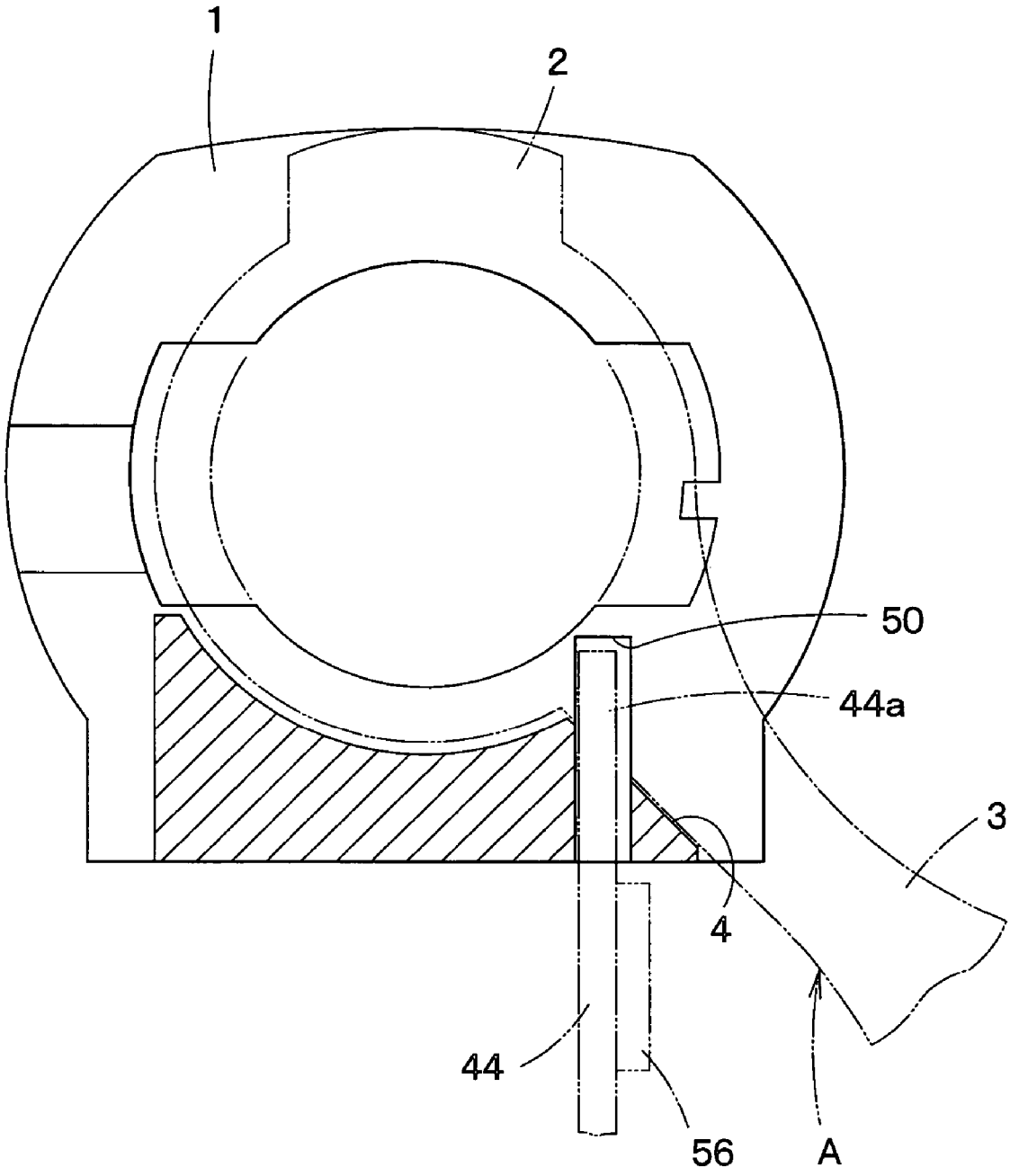
FIG. 7 is a sectional view taken on the line VII—VII in FIG. 4, in which the receiver is mainly shown.

Referring to FIGS. 4 to 6, a V-shaped safety lever (safety control member) 40 is placed in sliding contact with the outer surface 12*a* of the right side wall 12 and is supported for forward and backward turning by the support pin 16 on the right sidewall 12. The safety lever 40 has a sectorial central body 41, an operating arm 43 upwardly extending from an upper back part of the central body 41 and having a laterally extending end provided with a lever spur 42, and a bolt locking arm 44 upwardly extending from an upper front part of the central body 41. Three positioning holes 45, 46 and 47 are formed in the inner surface, facing the outer surface of the right side wall 12, of the central body 41 on a circle having its center on the axis of the support pin 16. The positioning holes 45, 46 and 47 position the safety lever 40 at first, second and third positions, respectively, and control the axial position of the safety lock 31. FIG. 4 shows the safety lever 40 positioned at the first position, namely, a perfect lock position P1, for locking the movement of both the bolt 2 and the trigger 15. FIG. 5 shows the safety lever 40 positioned at the second position, namely, a safety position P2, for locking the movement of only the trigger 15. FIG. 6 shows the safety lever positioned at the third position, namely, a firing position P3.

The first positioning hole 45 positions the safety lever 40 at the perfect lock position (the first position) P1. The first positioning hole 45 is a small cylindrical hole having a small diameter and a chamfered edge, and capable of receiving only the tip of the tapered outer end 34 of the safety lock 31. When the tip of the tapered outer end 34 of the safety lock 31 engages in the first positioning hole 45, the trigger blocking part 35 of the safety lock 31 projects into the groove 14 that is a space between the opposite side walls 11 and 12 of the casing 10 and lies at a trigger blocking position S1 in front of the upper arm 15*a* of the trigger 15 as shown in FIG. 3A. The second positioning hole 46 positions the safety lever 40 at the safety position (the second position) P2. The second positioning hole 46 is a medium cylindrical hole having a medium diameter and capable of partly receiving only the tapered outer end 34 of the safety lock 31. When the tapered outer end 34 of the safety lock 31 engages partly in the second positioning hole 46, the trigger blocking part 35 of the safety lock 31 projects into the groove 14 between the opposite side walls 11 and 12 of the casing 10 and lies at the trigger blocking position S1 in front of the upper arm 15*a* of the trigger 15 as shown in FIG. 3B.

The third positioning hole 47 positions the safety lever 40 at the firing position (the third position) P3. The third positioning hole 47 is a large tapered cylindrical hole having a large diameter and capable of entirely receiving the tapered outer end 34 of the safety lock 31. When the tapered outer end 34 of the safety lock 31 engages in the third positioning hole 47, the trigger blocking part 35 of the safety lock 31 is retracted into the hole in the right side wall 12 of the casing 10 and lies at a releasing position S2 outside the moving path of the upper arm 15*a* of the trigger 15, i.e., the groove 14 that is a space between the opposite side walls 11 and 12 of the casing 10, as shown in FIG. 3C.

The diameter of the safety lock 31 is determined such that the forward movement of the upper arm 15*a* of the trigger 15 is blocked by the safety lock 31 when the trigger 15 is pulled with the trigger blocking part 35 of the safety lock 31 being positioned at the trigger blocking position S1. Thus, the upper arm 15*a* of the trigger 15 remains in engagement with the sear 17. The outside diameter of the coil spring 33 is determined such that the upper arm 15*a* of the trigger 15 is disengaged from the sear 17 before the upper arm 15*a* of the trigger 15 comes into contact with the coil spring 33 when the trigger 15 is pulled with the safety lock 31 being retracted into the hole in the right side wall 12 to the releasing position S2. That is to say, the outside diameter of the coil spring 33 is determined so that the effective forward movement of the upper arm 15*a* of the trigger 15 may not be blocked by the coil spring 33.

Figure 8:
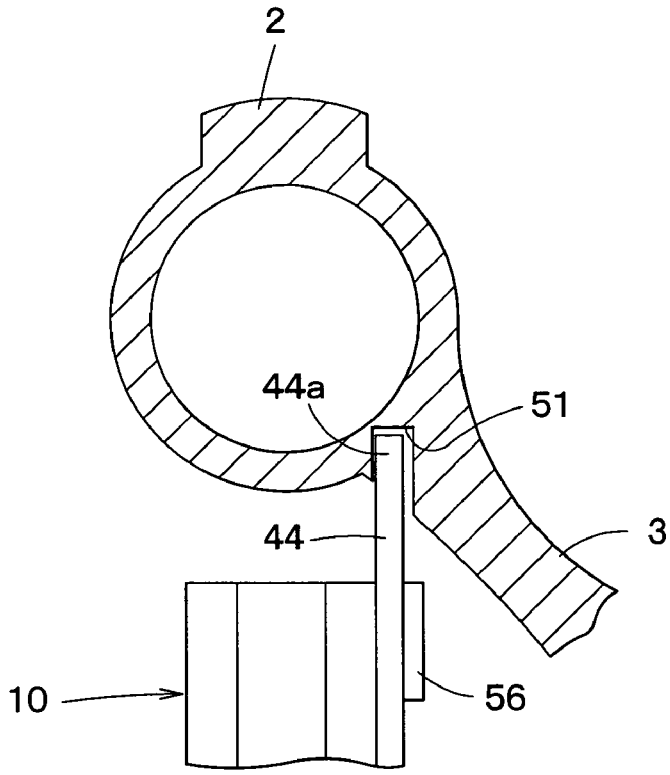
FIG. 8 is a cross-sectional view of the bolt included in the bolt-action firearm shown in FIG. 1, in which the groove of the bolt is mainly shown.

Referring to FIGS. 4 to 7, the bolt locking arm 44 of the safety lever 40 is provided at an end part thereof with a bolt blocking part 44*a* that moves in a groove 50 formed in the receiver 1. Referring to FIGS. 4 to 6 and 8, the bolt 2 is provided with a longitudinal stopping groove 51 in the back surface of a base part of the bolt handle 3. When the bolt handle 3 is turned to the closing angular position A, the stopping groove 51 is aligned longitudinally with the groove 50. In a firing state where the bolt 2 is inserted in the receiver 1 and the bolt handle 3 is set at the closing angular position A, the bolt blocking part 44*a* of the safety lever 40 is able to lie in the stopping groove 51 of the bolt 2 to block the rotational movement of the bolt 2 only when the safety lever 40 is positioned at the perfect lock position P1 (FIGS. 4 and 8).

Figure 9:
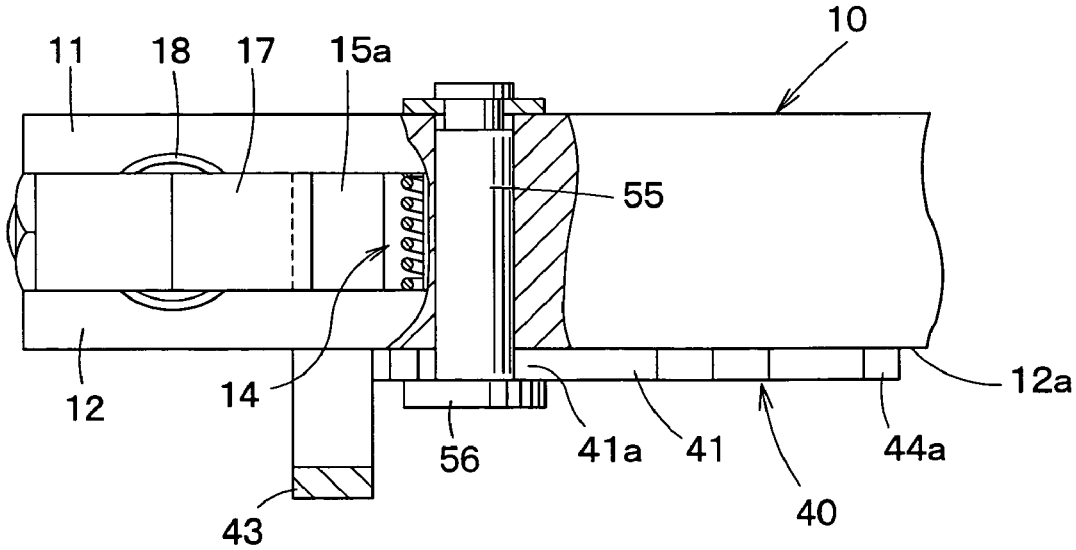
FIG. 9 is a view of taken in the direction of the arrow IX in FIG. 6, in which the circular retaining head for preventing the upper edge of the safety lever from being urged axially outward is shown.

As shown in FIG. 9, a stopper pin 55 is inserted in a hole formed in a part of the casing 10 above a sectorial central body 41 of the same. The axis of the stopper pin 55 is parallel to that of the support pin 16. Limiting projections 40*a* and 40*b* formed in the safety lever 40 come into engagement with the stopper pin 55 to limit the forward and the backward turning, respectively, of the safety lever 40. The stopper pin 55 is provided integrally with a circular retaining head 56 at its right end. The retaining head 56 engages with the upper edge 41*a* of the sectorial central body 41 of the safety lever 40 to restrain the safety lever 40 urged axially outward by the resilience of the coil spring 33, which axially outwardly urges the safety lock 31, from falling off the right side wall 12 so that the tip of the safety lock 31 can surely engage in one of the positioning holes 45, 46 and 47.

When the bolt 2 is inserted in the receiver 1, the bolt handle 3 is turned to the closing angular position A and the safety lever 40 is turned to the perfect lock position P1, the safety lock 31 engages in the first positioning hole 45 to retain the safety lever 40 at the perfect lock position P1. In this state, the trigger blocking part 35 of the safety lock 31 is at the trigger blocking position S1, and hence the forward turning of the upper arm 15*a* of the trigger 15 is blocked by the safety lock 31 and the trigger 15 cannot turn even if the same is pulled. Since the safety lock 31 is fitted in the sliding hole 30 of the casing 10 so as to be slidable in directions perpendicular to a plane in which the trigger 15 turns, and force applied to the trigger 15 is born by the casing 10, the safety lock 31 does not deform and is able to block the movement of the trigger 15 with reliability even if the trigger 15 is pulled strongly. In this state where the safety lever 40 is at the perfect lock position P1, the bolt blocking part 44*a* of the safety lever 40 is engaged in the stopping groove 51 of the bolt 2, the bolt 2 is locked perfectly and cannot be turned to open the chamber. Therefore, even if the chamber is loaded with a cartridge, the cartridge cannot be fired (FIGS. 4 ad 3A).

When the safety lever 40 is turned to the safety position P2, the safety lock 31 engages in the second positioning hole 46 to retain the safety lever 40 at the safety position P2. In this state, the trigger blocking part 35 of the safety lock 31 is at the trigger blocking position S1, and hence the forward turning of the upper arm 15*a* of the trigger 15 is blocked by the safety lock 31 and the trigger 15 cannot turn even if the same is pulled. In this state where the safety lever 40 is at the safety position P2, the bolt blocking part 44*a* of the safety lever 40 is disengaged from the stopping groove 51 of the bolt 2. Thus, the bolt 2 can be turned to open the chamber and can be longitudinally moved. Therefore, cartridges can be safely loaded in and unloaded from the chamber without the danger of accidental firing of the cartridges (FIGS. 5 and 3B).

When the safety lever 40 is turned to the firing position P3, the safety lock 31 engages in the third positioning hole 47 to retain the safety lever 40 at the firing position P3. In this state, the bolt blocking part 44*a* of the safety lever 40 is disengaged from the stopping groove 51 of the bolt 2, and the bolt 2 is released. Since the trigger blocking part 35 of the safety lock 31 is retracted from the position in front of the upper arm 15*a* of the trigger 15 to the releasing position S2, the upper arm 15*a* of the trigger 15 is able to turn forward as far as the same comes into contact with the coil spring 33 when the trigger 15 is pulled. Consequently, the upper arm 15*a* of the trigger 15 is disengaged from the sear 17, and the firing mechanism 5 operates (FIGS. 6 and 3C).

What is claimed is:

1. A safety mechanism for use in a bolt-action firearm that includes a receiver, a bolt axially slidably received in the receiver, a casing fastened to a lower part of the receiver, a firing mechanism, and a trigger having an upper arm and pivotally supported on the casing so as to be interlocked with the firing mechanism, the safety mechanism comprising:

a safety control member supported for turning on an outer surface of one of opposite side walls of the casing and capable of being selectively located in one of first, second and third positions so as to control movement of the trigger and the bolt, the safety control member having a bolt blocking part capable of engaging with the bolt;

a trigger blocking member slidably fitted in a sliding hole of the casing, the sliding hole being provided in the surface of the one of the opposite side walls of the casing, on which the safety control member is supported, the sliding hole opening into a space between the opposite side walls of the casing, in which the upper arm of the trigger moves, the trigger blocking member having a trigger blocking part capable of moving so as to be advanced into and retracted from a moving path of the upper arm of the trigger; and a spring urging the trigger blocking member fitted in the sliding hole of the casing toward the safety control member;

wherein the safety control member is provided with first, second and third positioning holes arranged on a circle having its center on an axis on which the safety control member turns; the trigger blocking member engages in the first, the second and the third positioning holes of the safety control member to locate the safety control member in the first, the second and the third positions, respectively; the bolt blocking part of the safety control member is engaged with the bolt to block the movement of the bolt when the safety control member is located in the first position, whereas the bolt blocking part of the safety control member is disengaged from the bolt to permit the bolt to be operated when the safety control member is located in the second or the third position; the trigger blocking part of the trigger blocking member is advanced into the moving path of the upper arm of the trigger to block the movement of the trigger when the safety control member is located in the first or the second position, whereas the trigger blocking part of the trigger blocking member is retracted from the moving path of the upper arm of the trigger to permit the trigger to move when the safety control member is positioned in the third position.

2. The safety mechanism according to claim 1, wherein the first and the second positioning holes of the safety control member are formed in a shape such that the trigger blocking part of the trigger blocking member lies inside the moving path of the upper arm of the trigger when an outer end part of the trigger blocking member is engaged in the first or the second positioning hole; and the third positioning hole is formed in a shape such that the trigger blocking part of the trigger blocking member lies outside the moving path of the upper arm of the trigger when the outer end part of the trigger blocking member is engaged in the third positioning hole.

3. The safety mechanism according to claim 2, wherein the outer end part of the trigger blocking member is tapered; the third positioning hole is a tapered hole having a large diameter and capable of entirely receiving the tapered outer end part of the trigger blocking member to locate the trigger blocking part of the trigger blocking member at a releasing position outside the space between the opposite side walls of the casing; the first and the second positioning holes are tapered holes having small diameters and capable of partly receiving the tapered outer end part of the trigger blocking member to locate the trigger blocking part of the trigger locking member at a blocking position inside the space between the opposite side walls of the casing.

4. The safety mechanism according to claim 1, wherein the sliding hole of the casing is provided in a part of the casing which part corresponds to a position in front of the upper arm of the trigger, and the sliding hole of the casing has an axis parallel to an axis about which the trigger turns.

5. The safety mechanism according to claim 1, wherein the safety control member is supported for turning on the same axis as the axis around which the trigger turns.

6. The safety mechanism according to claim 1, wherein the safety control member has a sectorial central body, an operating arm upwardly extending from an upper back part of the central body, and a bolt locking arm upwardly extending from an upper front part of the central body, the bolt locking arm serves as the bolt blocking part; the central body of the safety control member is provided with the three positioning holes formed in an inner surface thereof facing the outer surface of the one of the opposite side walls of the casing; and the bolt locking arm of the safety control member is engaged in a longitudinal groove formed in the bolt to block the movement of the bolt.

7. The safety mechanism according to claim 6, further comprising a safety control member retaining member supported on the casing in sliding contact with an upper edge of the central body of the safety control member to retain the safety control member in place on the casing.

* * * * *